US006618326B1

(12) United States Patent
Satodate et al.

(10) Patent No.: US 6,618,326 B1
(45) Date of Patent: Sep. 9, 2003

(54) ELECTRONIC TIMEPIECE HAVING INDICATION HANDS

(75) Inventors: Takayuki Satodate, Chiba (JP); Yuichi Shino, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/914,520

(22) PCT Filed: Jan. 24, 2000

(86) PCT No.: PCT/JP00/00325

§ 371 (c)(1),
(2), (4) Date: Jan. 3, 2002

(87) PCT Pub. No.: WO01/55799

PCT Pub. Date: Aug. 2, 2001

(51) Int. Cl.[7] ..... G04B 19/04; G04B 25/00
(52) U.S. Cl. ..... 368/80; 368/223
(58) Field of Search ..... 268/72–74, 76, 268/80, 223, 228, 238

(56) References Cited

U.S. PATENT DOCUMENTS 4,474,480 A * 10/1984 Kato ..... 368/10
5,202,858 A * 4/1993 Kanzaki ..... 368/71
5,889,736 A * 3/1999 Fujita et al. ..... 368/66

FOREIGN PATENT DOCUMENTS

| | | |
|---|---|---|
| GB | 8326155 | * 11/1983 |
| JP | 57-153294 | * 9/1982 |
| JP | 60-27389 | * 2/1985 |
| JP | 4-315987 | * 11/1992 |
| JP | 4-366788 | * 12/1992 |

* cited by examiner

*Primary Examiner*—Vit Miska
(74) *Attorney, Agent, or Firm*—Adams & Wilks

(57) ABSTRACT

An electronic timepiece with indicator hands (100) having indicator hands capable of providing a variety of indications and capable of preventing unstable operation due to irregular movement of the indicator hand, which comprises: time hands (101, 102) showing time; first and second indicator hands (103, 104) provided separately from said time hands (101, 102); rotation means for reciprocally rotating said first and second indicator hands (103, 104) in directions opposite to each other within a predetermined range; and restricting means for restricting the range in which said first and second indicator hands (103, 104) can move. Where the indicator hands (103, 104) are rotating toward an outside of a restriction range due to impact or the like, the rotation is restricted by the restricting means.

6 Claims, 13 Drawing Sheets

ELECTRONIC TIMEPIECE HAVING INDICATION HANDS

TECHNICAL FIELD

The present invention relates to an electronic timepiece with indicator hands integrally formed with figures or the like.

BACKGROUND OF THE INVENTION

Conventionally, electronic timepieces with indicator hands integrally formed with figures, such as characters, have been utilized.

In the conventional electronic timepiece with indicator hands, the hand having a function as an indicator hand is structured by a needle-shaped second hand or disk-formed second hand wherein the second hand serves also as the indicator hand. Meanwhile, also in the conventional timepiece having an indicator hand moved only by user's operation, the indicator hand has been used also as a time hand to show time. Alternatively, the indicator hand has been moved by interlocking with the time hand.

Consequently, in any of the electronic timepieces, there is nothing more than having one indicator hand serving also to show a time. With one indicator hand only, it is impossible to provide a variety of motions to the figure, such as a character, and thus it has been impossible to give a variety of indications.

Meanwhile, although there have existed the timepieces having indicator hands moving at all times, these are nothing more than merely having a figure or the like on a disk-formed second hand or needle-like second hand. Thus, a variety of indications, e.g. providing a variety of motions, have been impossible to perform.

Also, where the indicator hand serves also as a time hand or is moved by interlocking with the time hand, the figure or the like integrally formable on the indicator hand is restricted in size by the restriction due to moment of the hand. Thus, it has been impossible to use an indicator hand capable of providing a variety of indications.

It can be considered as a method of solving this problem and realizing a variety of indications by the indicator hand to provide a plurality of indicator hands separately from the time hands and providing a structure for reciprocally moving the indicator hands.

However, in the case of merely reciprocally moving the indicator hands, there is a fear that jumping of the indicator hand due to impact or the like occurs, resulting in unstable movement of indication.

It is an object of the present invention to provide on electronic timepiece with indicator hands capable of variety of indications and also preventing the occurrence of unstable operation due to jumping of the indicator hand or the like.

DISCLOSURE OF THE INVENTION

The present invention adopts the technology described below in order to achieve the above object.

That is, an electronic timepiece with indicator hands according to the present invention is characterized by comprising: time hands showing time; first and second indicator hands provided separately from the time hands; rotation means for reciprocally rotating the first and second indicator hands in directions opposite to each other within a predetermined range, and restricting means for restricting the range in which the first and second indicator hands can move. The rotation means reciprocally rotates the first and second indicator hands in directions opposite to each other within a predetermined range. Where the first and second indicator hands are moving toward the outside of the restriction range due to impact or the like, the restriction means restricts the movement. This makes it possible to provide an electronic timepiece with indicator hands capable of preventing the occurrence of unstable operation due to jumping of the indicator hand or the like.

Here, the rotation means may reciprocally rotate the first and second indicator hands at the same speed.

Also, the rotation means may comprise a motor doing alternately forward rotation and reverse rotation by a predetermined amount, and a train wheel for delivering rotation of the motor to the first and second indicator hands.

Furthermore, the restricting means may comprise a first engaging part fixed in a predetermined position and a second engaging part provided in a wheel included in the train wheel, wherein the first engaging part and the second engaging part are engaged to restrict rotation of the indicator hand when the indicator hand is rotating toward an outside of a predetermined restricting range.

Here, the first engaging part may comprise a pin member fixed in a predetermined position, and the second engaging part may comprise the ends formed by providing a hole in the wheel. Meanwhile, the first engaging part may comprise a convex part fixed in a predetermined position, and the second engaging part may comprise a convex part formed integral with the wheel.

Incidentally, the electronic timepiece may be an electronic wristwatch.

BEST MODE FOR CARRYING OUT THE INVENTION

Hereunder, concrete examples of electronic timepieces with indicator hands according to the present invention will be explained in detail with reference to the drawings.

Figure 1:
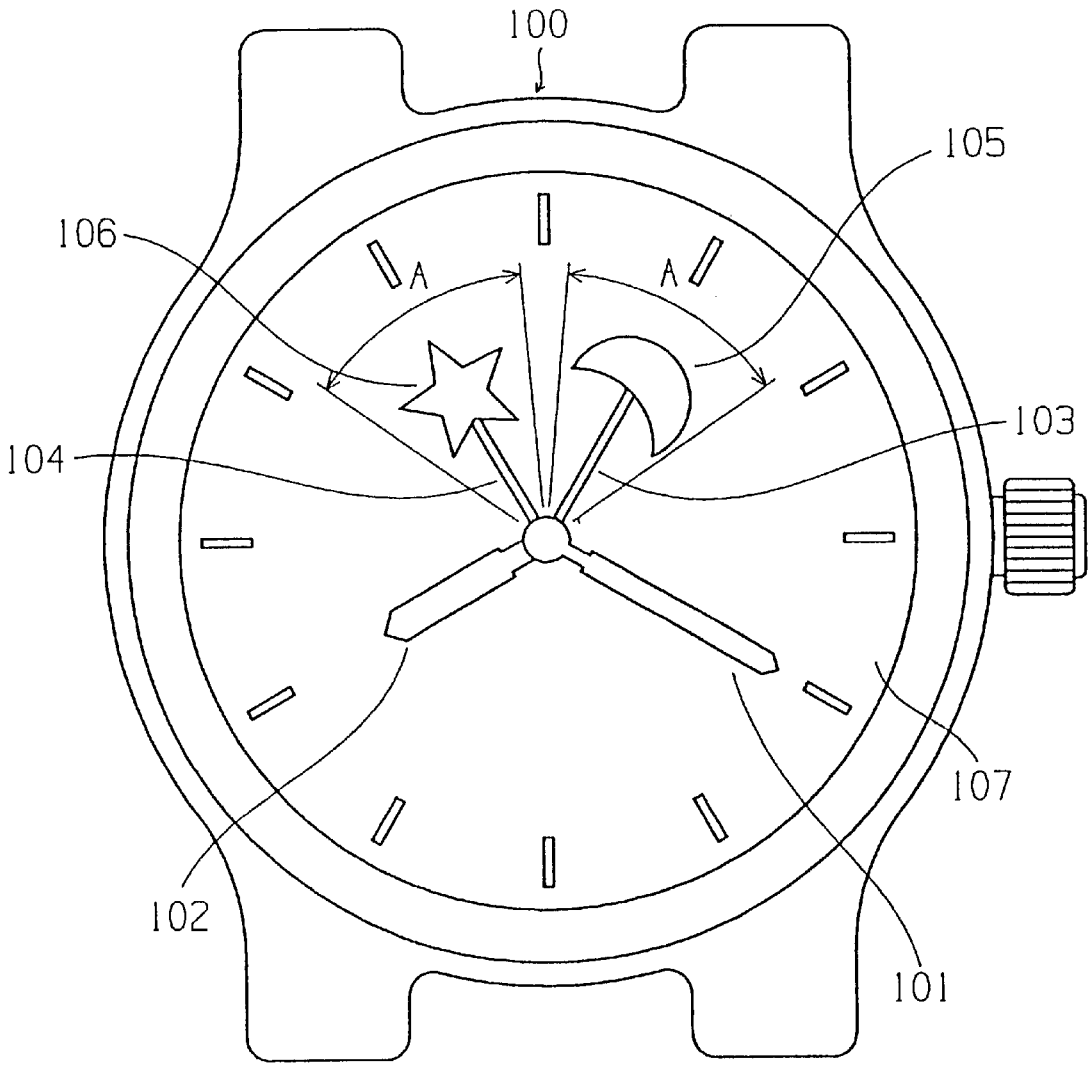
FIG. 1 is a front view showing an outside view of a concrete example of an electronic timepiece with indicator hands according to the present invention.

FIG. 1 is a front view showing an external view of a concrete example of an electronic timepiece with indicator hands according to the invention, showing an example of electronic wristwatch. In FIG. 1 an electronic wristwatch with indicator hands 100 has time hands of a minute hand 101 and an hour hand 102 to represent a time and provided with a first indicator hand 103 formed integral with a crescent-shaped figure 105 and a second indicator hand 104 formed integral with a star-shaped figure 106. The indicator hands 103, 104 are coaxially arranged between the minute hand 101 and hour hand 102 and the dial 107.

As described hereafter, by using two train wheels having as a drive source a motor different from a motor for driving the time hands 101, 102 to have a reduction ratio corresponding to a second hand and transmitting rotation opposite in direction with respect to the indicator hands 103, 104, a pair of indicator hands 103, 104 are each driven and rotated such that they respectively reciprocate in opposite direction at the same speed and in the same predetermined angle A.

Figure 2:
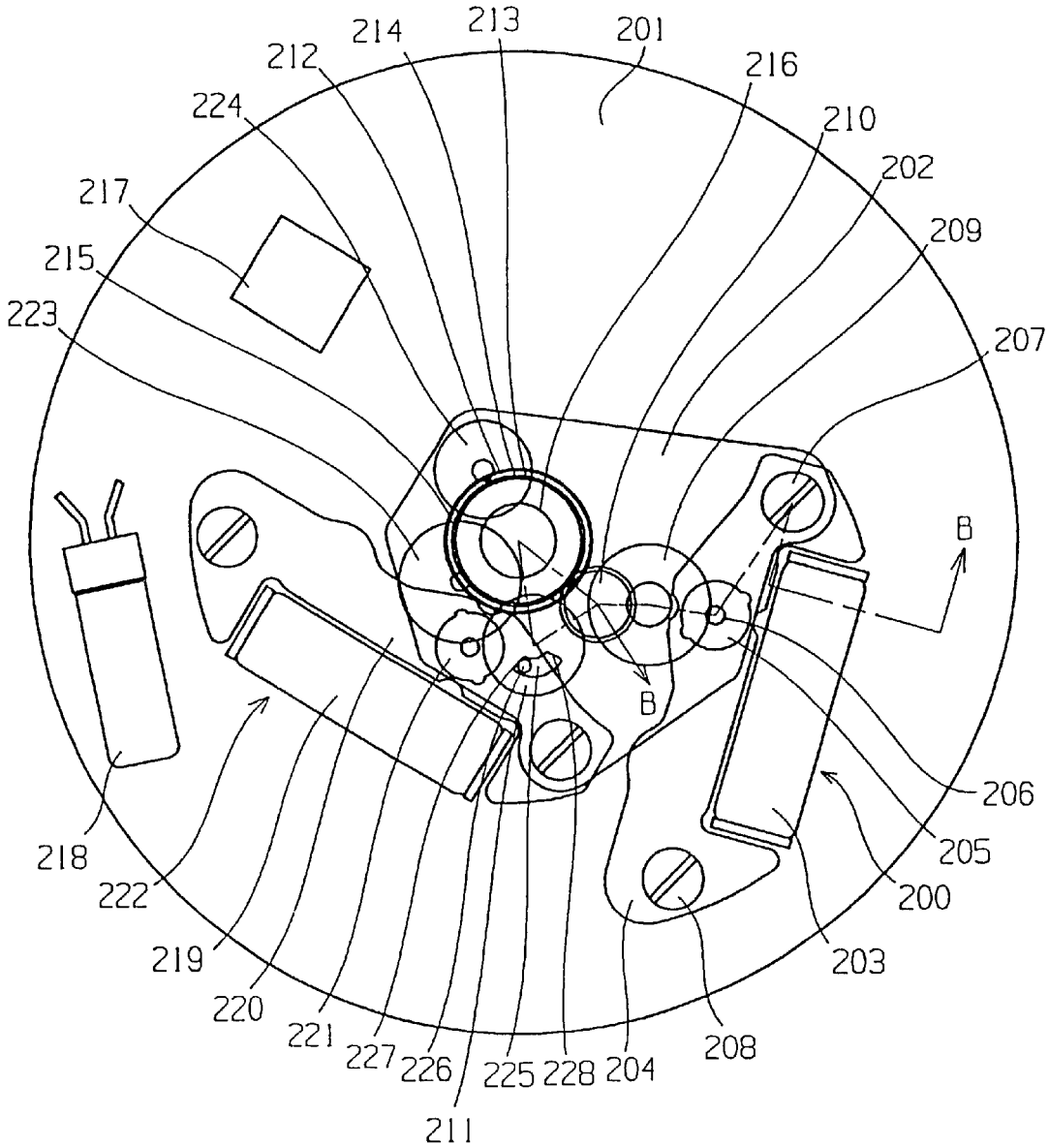
FIG. 2 is a rear view of a driving mechanism to be used in the concrete example of the electronic timepiece with indicator hands according to the invention.
Figure 3:
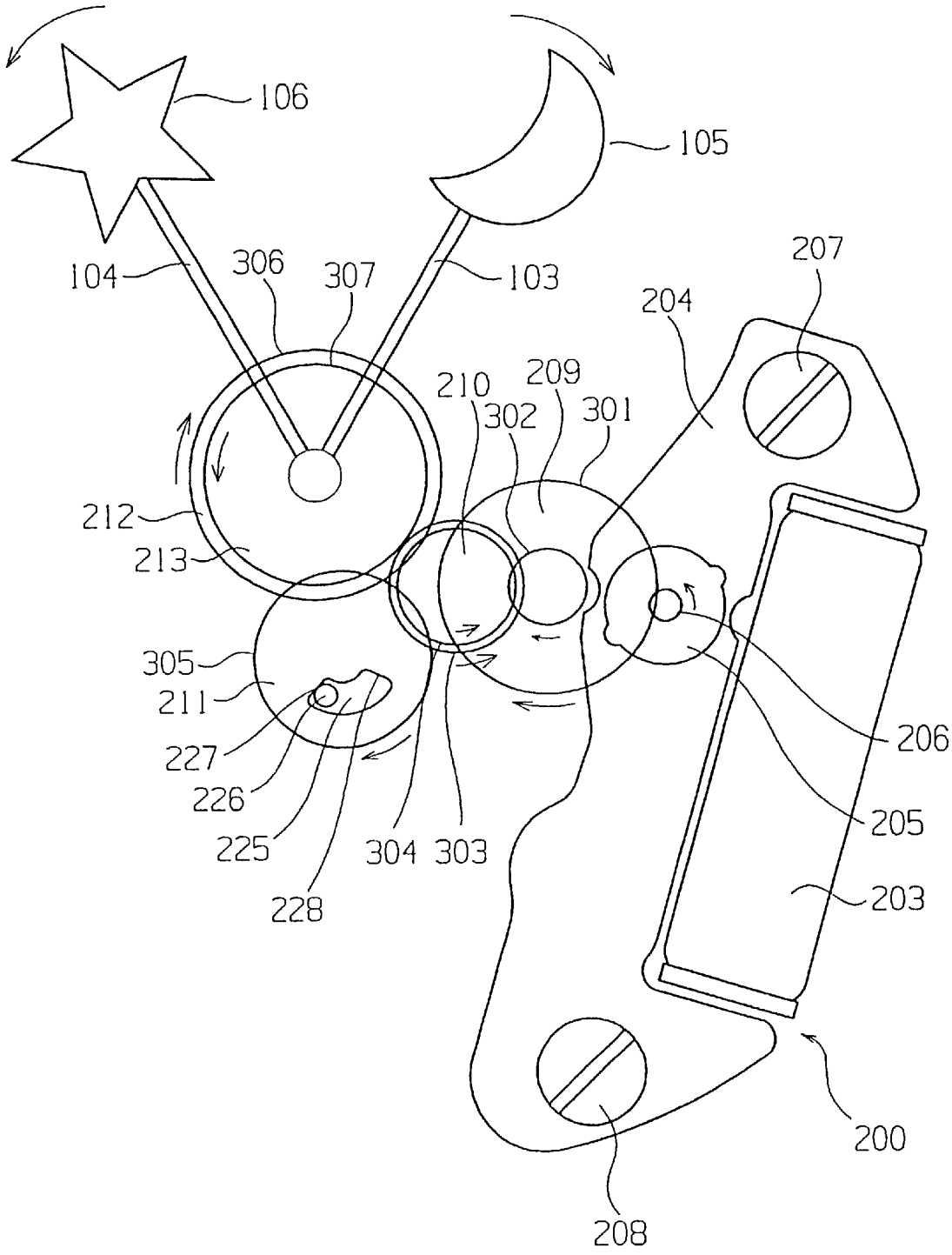
FIG. 3 is an enlarged rear view of a driving mechanism to be used for the concrete example of the electronic timepiece with indicator hands according to the invention.
Figure 4:
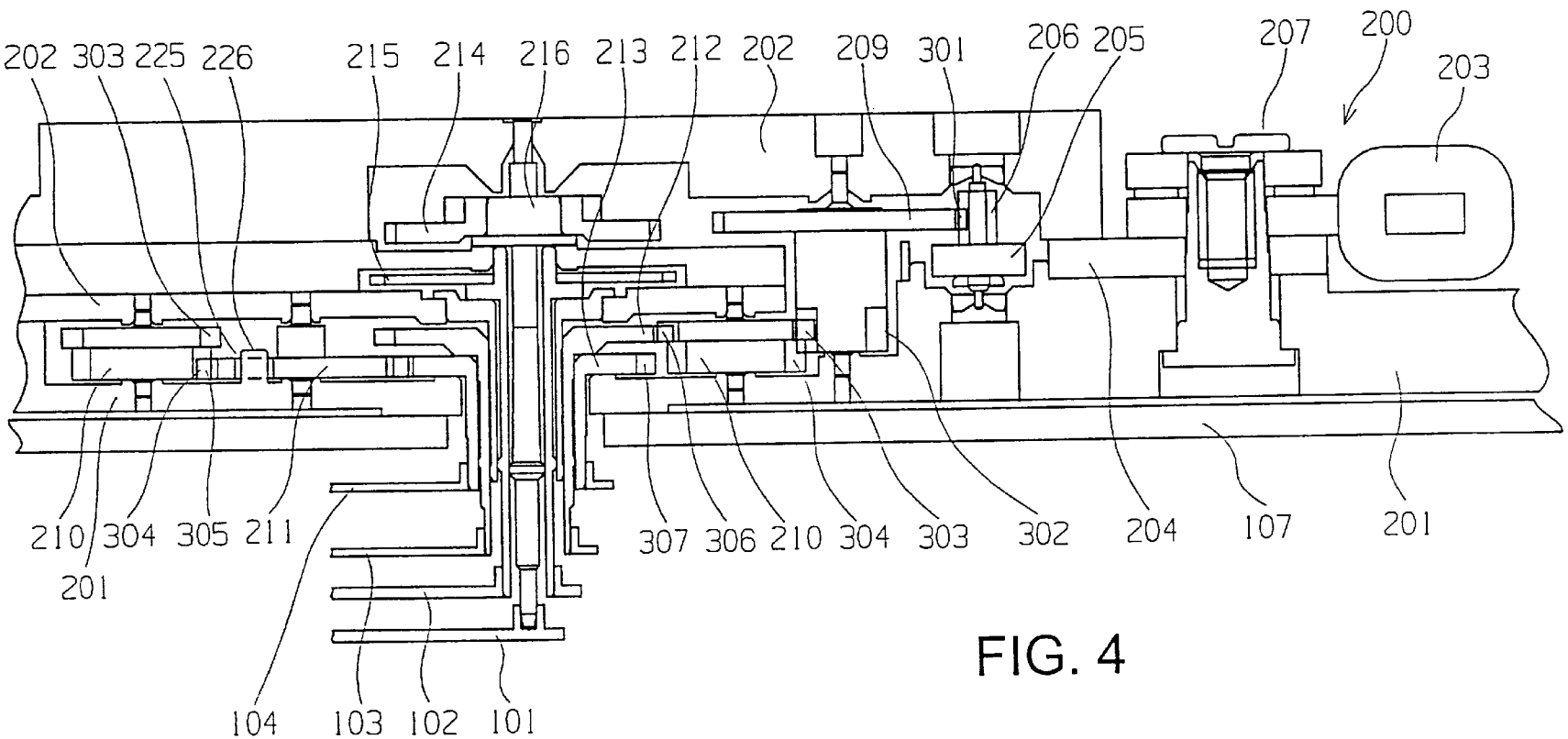
FIG. 4 is a B—B sectional view in FIG. 2.
Figure 5:
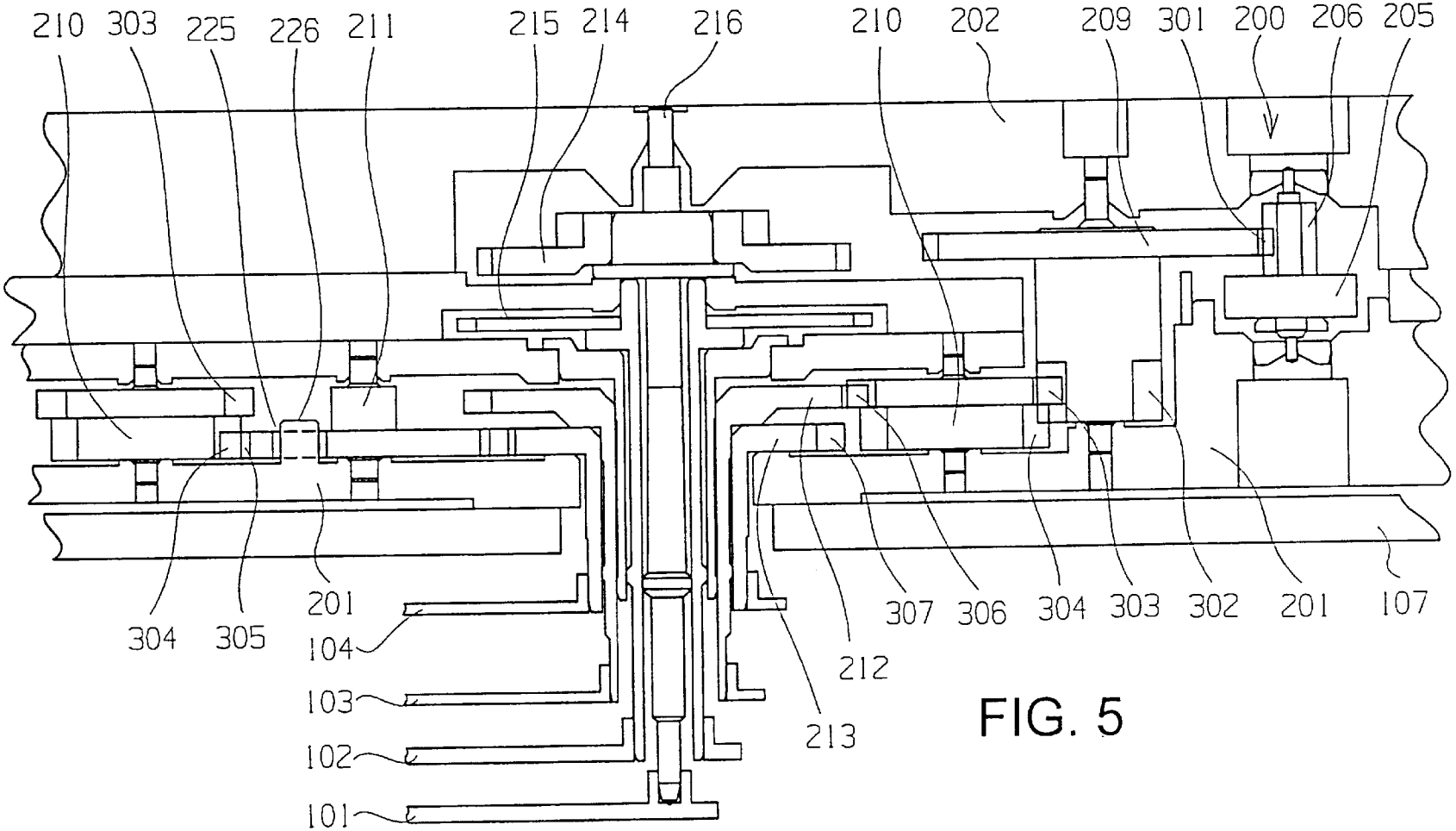
FIG. 5 is a partially enlarged sectional view of FIG. 4

FIG. 2 is a rear view showing a driving mechanism of the electronic wristwatch with indicator hands 100 shown in FIG. 1. FIG. 3 is an enlarged rear view showing the driving mechanism of the electronic timepiece with indicator hands shown in FIG. 1. FIG. 4 is a B—B sectional view in FIG. 2 and FIG. 5 is a partially enlarged sectional view of FIG. 4. In the figures, the identical parts are given identical reference numerals.

In FIG. 2 to FIG. 5, between a main plate 201 and a support plate 202, there are accommodated the time hands of the minute hand 101 and the hour hand 102, a driving mechanism to rotatively drive the pair of indicator hands 103, 104 and an electronic circuit. Concretely, they are structured as described below.

A first stepping motor 200 comprising a coil 203, a stator 204 and a rotor magnet 205, is a well-known stepping motor for a timepiece (see, for example, Japanese Patent Laid-open No. 127365/1979). As described later, this provides forward rotation drive and reverse rotation drive so as to reciprocally rotate the indicator hands 103, 104 in directions opposite to each other within a predetermined range (in an angular range A in FIG. 1). The stator 204 and coil 203 are fixed on the main plate 201 with screws 207, 208.

The rotor magnet 205 has a gear 206 which is in mesh with a gear 301 of a wheel 209. The wheel 209 has a pinion 302 which is in mesh with a gear 303 of a wheel 210. Also, the gear 303 of the wheel 210 is in mesh with a gear 306 of an hour wheel 212 to rotatively drive the indicator hand 103.

On the other hand, a pinion 304 of the wheel 210 is in mesh with a gear 305 of a wheel 211 for reverse rotation. Also, the gear 305 of the wheel 211 is in mesh with a gear 307 of the hour wheel 213 to rotatively drive the indicator hand 104.

The wheel 211 has an elongate hole 225 formed along a circumferential direction thereof. Due to this, ends 227, 228 are formed as a second engaging part in the wheel 211. A pin member 226 as a first engaging part is inserted through the hole 225, which is planted and fixed on the main plate 201. The ends 227, 228 of the wheel 211 and the pin member 226 constitute restricting means to restrict the range of rotation of the indicator hands 103, 104. When the indicator hands 103, 104 are about to rotate outside the predetermined restricting range (e.g. angular range A in FIG. 1), the pin member 226 and the end 227, 228 of the wheel 211 comes into engagement to structurally restrict the rotation of the indicator hands 103, 104.

Meanwhile, the wheels 209, 210 and the hour wheel 212 constitute a first train wheel to deliver rotation reverse to a rotational direction of the stepping motor 200 (i.e. rotational direction of the rotor magnet 205) to the first indicator hand 103. The wheels 209, 210, 211 and the hour wheel 213 constitute a second train wheel which delivers rotation in the same direction as a rotational direction of the stepping motor 200 to the second indicator hand 104. Here, formed the same are the gear ratio of the first train wheel of from the pinion 302 of the wheel 209 to the gear 306 of the hour wheel 212 and the gear ratio of the second train wheel of from the pinion 302 of the wheel 209 to the gear 307 of the hour wheel 213. The indicator hand 103 and the indicator hand 104 are structured such that they are driven and rotated at the same speed in directions opposite to each other. This rotatively drives the crescent-shaped figure 105 integrally formed on the indicator hand 103 and the star-shaped figure 106 integrally formed on the indicator hand 104 at the same speed in directions opposite to each other.

Incidentally, the stepping motor 200, the wheels 209, 210, 211, the hour wheels 212, 213 constitute rotation means for reciprocally rotating the first and second indicator hands 103, 104 oppositely in a predetermined range.

On the other hand, the electronic wristwatch 100 has drive means for rotatively driving the time hands of the minute hand 101 and the hour hand 102. That is, it is provided with a stepping motor 222 which is structured by a coil 219, a stator 220 and a rotor magnet 221. Further, it is provided with a third train wheel structured by wheels 223, 224 for delivering rotation of the rotor magnet 221, a wheel 214 for rotatively driving the minute hand 101 and an hour wheel 215 for rotatively driving the hour hand 102.

The hour wheels 212, 213, 215 are concentrically arranged on a shaft 216 formed integral with the wheel 214.

Also, an electronic circuit is incorporated which comprises an integrated circuit 217 incorporating therein a quartz oscillator 218 and driver circuit constituting an oscillator circuit.

Figure 6:
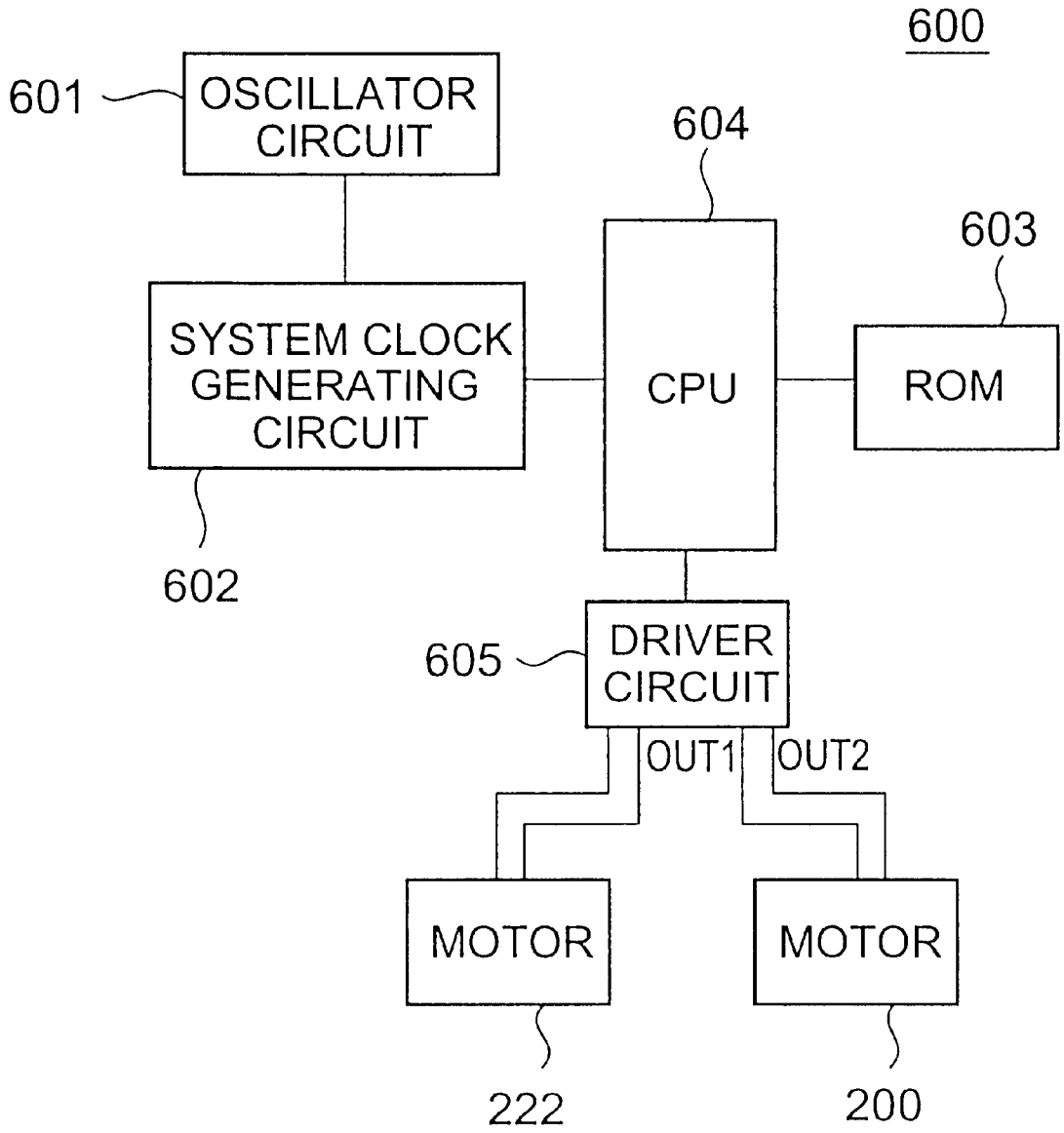
FIG. 6 is a block diagram of a driver circuit to be used for the concrete example of the electronic timepiece with indicator hands according to the invention.

FIG. 6 is a block diagram of a driver circuit 600 used in one embodiment of an electronic timepiece with indicator according to the invention, wherein the same reference numerals are given to the same parts of FIG. 1 to FIG. 5. In FIG. 6, the driver circuit 600 has an oscillator circuit 601 comprising a quartz oscillator 218 or the like, a system clock generating circuit 602 for generating a system clock from an output signal from the oscillator circuit 601, a non-volatile read only memory (ROM) 603 storing programs and motor driving pulses, described hereafter, and constituting storage means, a central processor unit (CPU) 604 to be operated by a program stored in the ROM 603 in response to a system clock from the system clock generating circuit 602 and performs various operations and driving and controlling of the stepping motor 200, 222, a driver circuit 605 for supplying a drive signal to the stepping motor 200, 222, a stepping motor 200 for driving and rotating the indicator hands 103, 104, and a stepping motor 222 for driving and rotating the minute hand 101 and the hour hand 102.

Figure 7:
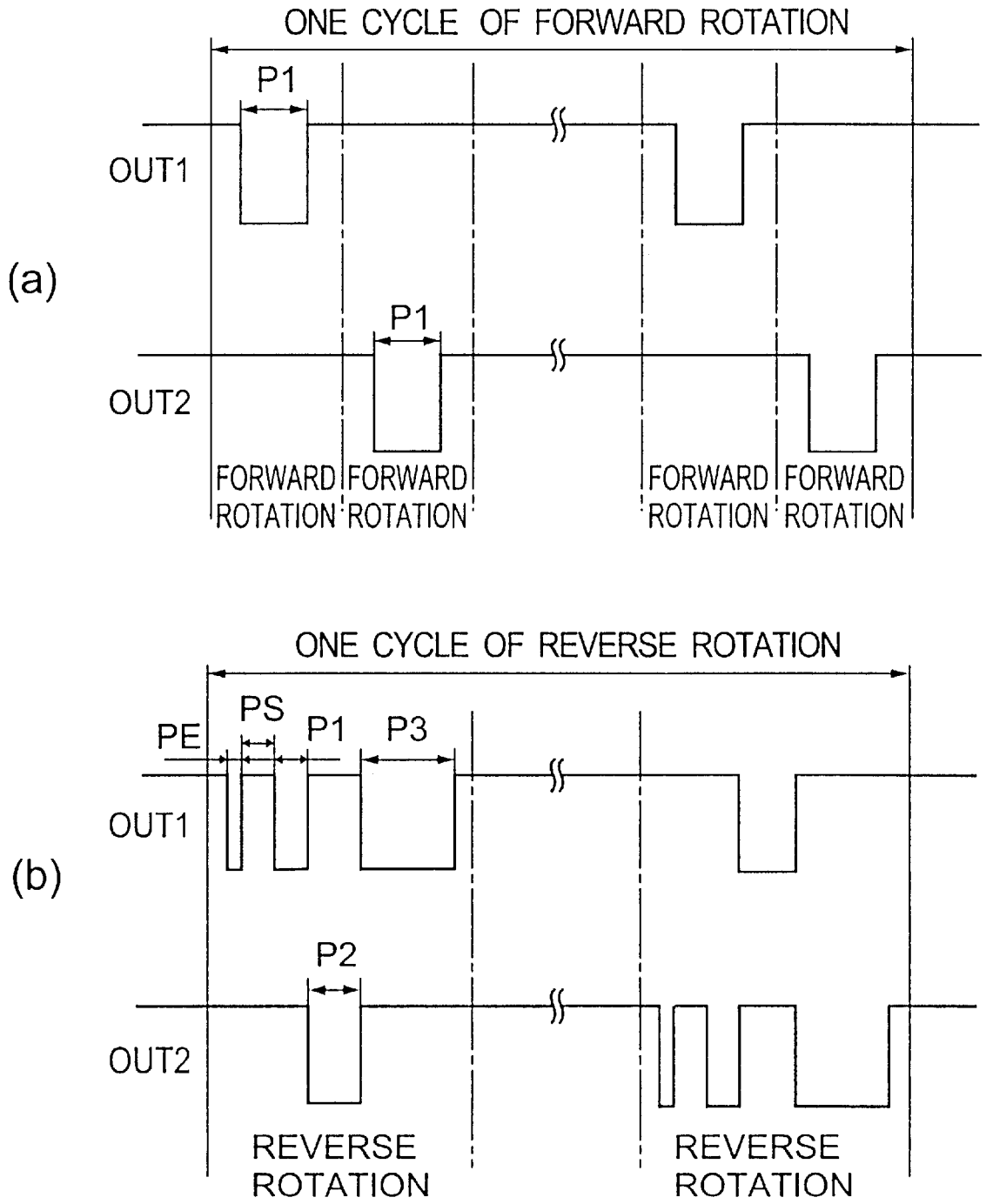
FIG. 7 is a timing view for explaining the operation of the driver circuit shown in FIG. 6.

The ROM 603 stores a drive pulse waveform shown in FIG. 7. Where driving the stepping motor 200 forward or reverse, the CPU 604 reads the drive pulse out of the ROM 603 and drive the stepping motor 200 forward or reverse through the driver circuit 605 (see, for example, the aforesaid Japanese Patent Laid-open publication).

That is, in FIG. 7, where the stepping motor 200 is rotated forward, it is rotated forward by applying a pulse with a time width P1 to a terminal OUT1 as shown in FIG. 7(*a*). Next, a pulse with a time width P1 is applied to a terminal OUT2 to cause forward rotation. This is alternately repeated by one period (e.g. 10 times of forward rotation), thereby repeating forward rotation of the stepping motor 200.

Also, in the case of reversely rotating the stepping motor 200, first a demagnetizing pulse with a time width PE is supplied to the terminal OUT1 as shown in FIG. 7(*b*). After a lapse of a time PS, a pulse with a time width P1 is supplied to once cause forward rotation. Thereafter, a pulse with a time width P2 for reverse rotation is supplied to the terminal OUT2, and thereafter a pulse with a time width P3 for reverse rotation is supplied to the terminal OUT1. This causes the stepping motor 200 to rotate reverse. The above operation is made by one period (e.g. 10 times of reverse rotation).

Thereafter, forward rotation and reverse rotation as above, by one period each, are alternately made to cause the stepping motor 200 to rotate forward and reverse by the same predetermined amount a time. This is repeated.

This rotatively drives the rotor magnet 205 of the stepping motor 200 alternately in forward and reverse directions by a same amount a time.

If the stepping motor 200 is rotated forward (in the arrowed direction in FIG. 3) by a predetermined number of times, the wheel 209, the wheel 210, and the hour wheel 212 rotate in respective arrowed directions. Due to this, the indicator hand 103 rotates by an angular rage A in the arrowed direction (clockwise). Simultaneously, the wheel 211 in mesh with the wheel 210 rotates in the arrowed direction to rotate the hour wheel 213 in the arrowed direction, rotating the indicator hand 104 by the angular range A in the arrowed direction (counterclockwise).

Next, when the stepping motor 200 rotates reverse (in a direction opposite to the arrow in FIG. 3) by the predetermined number of times, the wheel 209, the wheel 210, and the hour wheel 212 rotate in a direction opposite to the arrow. Due to this, the indicator hand 103 rotates by the angular range A. Simultaneously, the wheel 211 in mesh with the wheel 210 rotates in a direction opposite to the arrow. This causes the hour wheel 213 to rotate in a direction opposite to the arrow, rotating the indicator hand 104 by the angular range A in the direction opposite to the arrow (clockwise).

Thereafter, the above movement is repeated. Due to this, the crescent-shaped figure 105 integral with the indicator hand 103 and the star-shaped figure 106 integral with the indicator hand 104 reciprocally move at the same speed in directions opposite to each other in the same angular range A. Incidentally, the range of rotation of the indicator hand 103, 104, i.e. the range of rotation angle A in FIG. 1 is determined by the amount (number) of forward and reverse rotation of the stepping motor 200. By setting a rotation amount of the stepping motor 200 in various ways, the rotational range of the indicator hand 103, 104 can be set variously. Accordingly, it is possible to reciprocally rotate the crescent figure 105 and the star figure 106 in a variety of ranges.

When the indicator hands 103, 104 reciprocally move normally within the angular range A in the above manner, in the event that the indicator hand 103, 104 irregularly move due to mechanical impact or the like and moves toward an outside of the angular range A, the wheel 211 rotates due to rotation of the indicator hands 103, 104. However, the ends 227, 228 of the wheel 211 formed by the hole 225 engages the pin member 226, thus restricting the indicator hand 103, 104 from rotating furthermore. This can prevent the indicator hands 103, 104 from moving abnormally.

Figure 8:
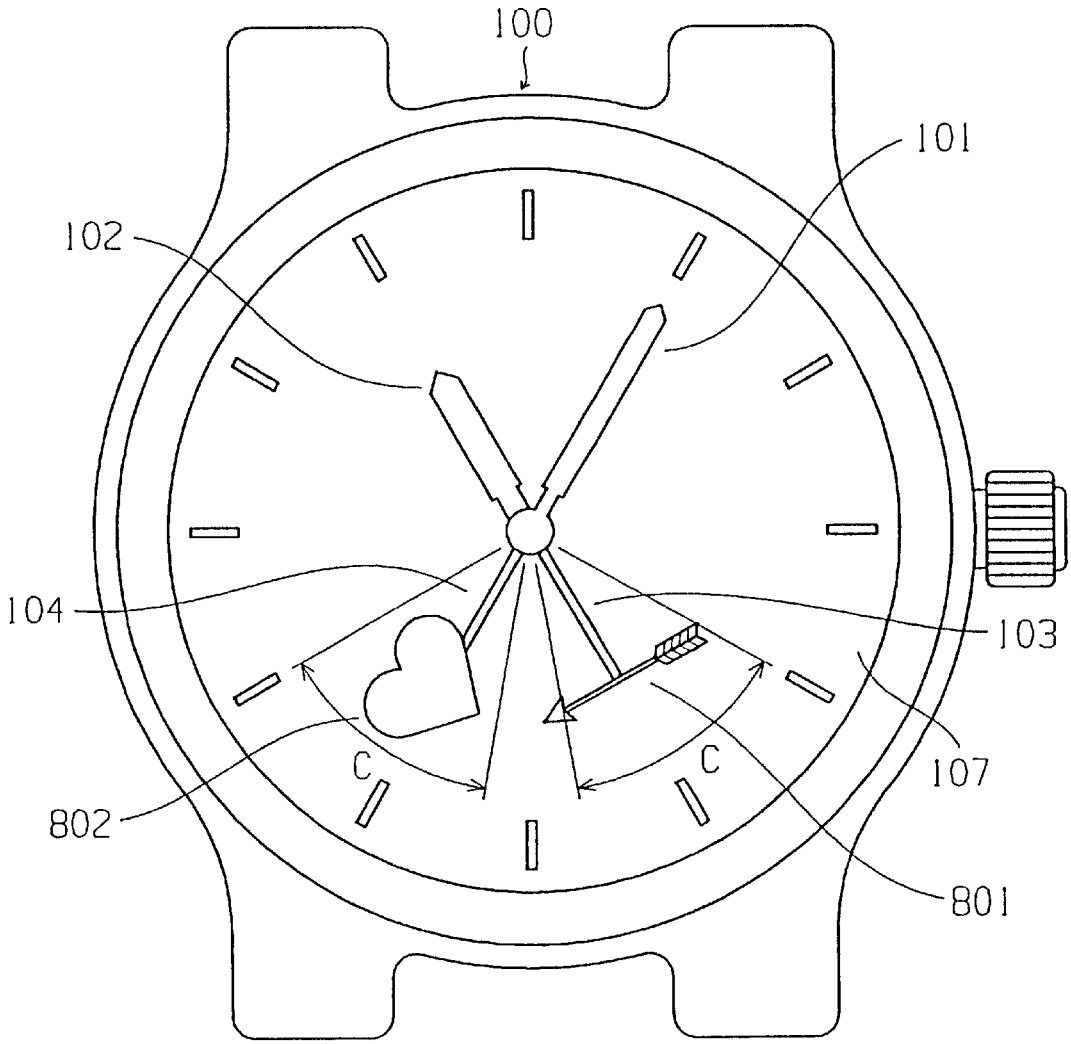
FIG. 8 is a front view showing an outside view of another concrete example of an electronic timepiece with indicator hands according to the present invention.

FIG. 8 is a front view showing an external view of another concrete example of an electronic wristwatch with indicator hands according to the invention. The identical parts to FIG. 1 are given the identical reference numerals.

In FIG. 8, an electronic wristwatch with indicator hands 100 has time hands comprising a minute hand 101 and an hour hand 102, and provided with a first indicator hand 103 formed integral with an arrowed figure 801 and a second indicator hand 104 formed integral with a heart-shaped figure 802. The indicator hands 103, 104 are arranged between the minute hand 101 and the hour hands 102 and the dial 107. A pair of indicator hands 103, 104 are each driven and rotated to reciprocally move at the same speed in directions opposite to each other within the same predetermined range of angle C.

Figure 9:
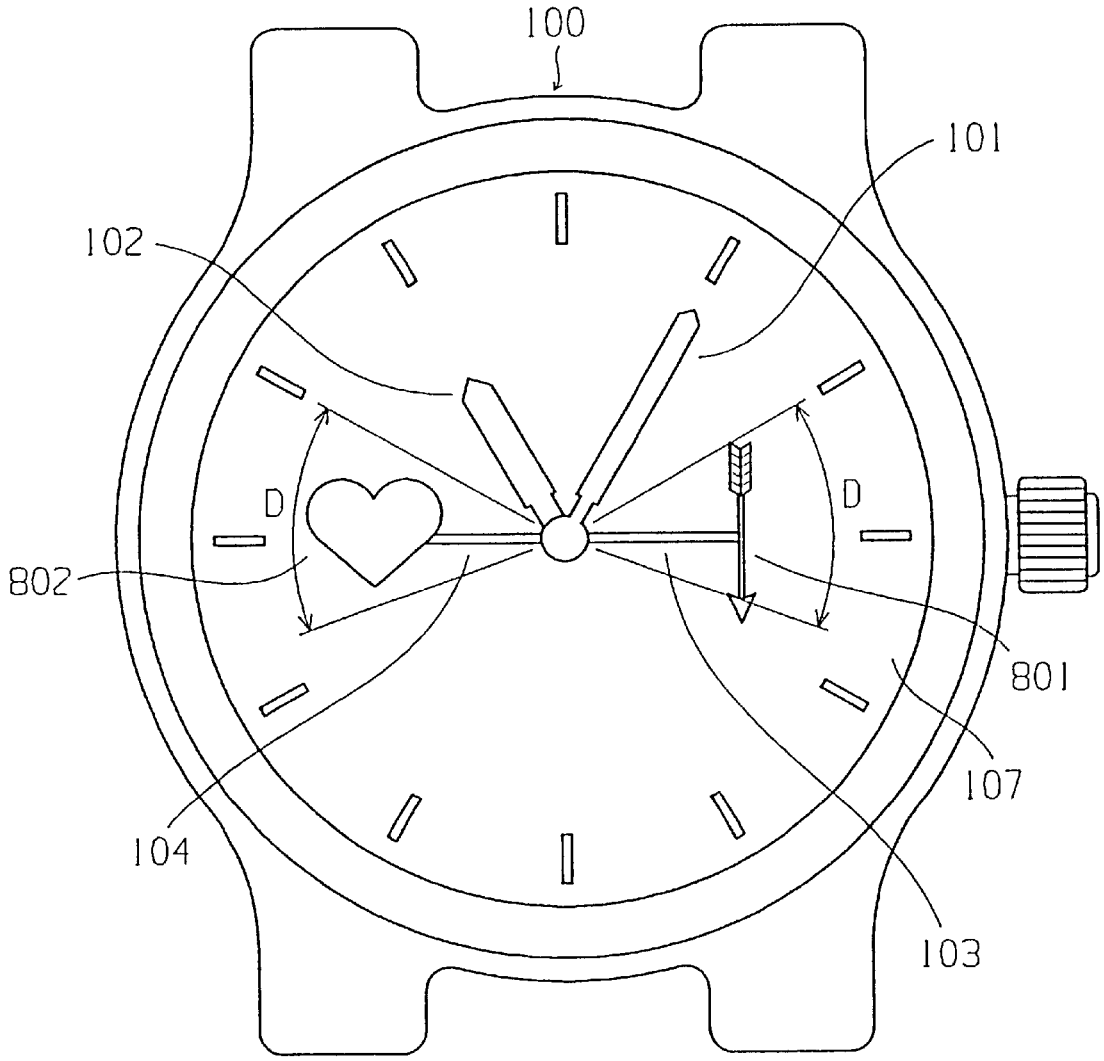
FIG. 9 is a front view showing an outside view of another concrete example of an electronic timepiece with indicator hand according to the present invention.

FIG. 9 is a front view showing an external view of another concrete example of an electronic wristwatch with indicator hands according to the invention. The identical parts to FIG. 1 and FIG. 8 are given the identical reference numerals.

In FIG. 9, an electronic wristwatch with indicator hands 100 has time hands comprising a minute hand 101 and an hour hand 102 and also is provided with a first indicator hand 103 formed integral with an arrowed figure 801 and a second indicator hand 104 formed integral with a heart-shaped figure 802. A pair of indicator hands 103, 104 are arranged between the minute hand 101 and hour hands 102 and the dial 107. The indicator hands 103, 104 are each driven and rotated to reciprocally move at the same speed in directions opposite to each other within the same predetermined range of angle D.

As shown in FIG. 1, FIG. 8, and FIG. 9, a variety of representations can be provided by making the figures put on the indicator hands 103, 104 with various figures such as characters or letters, changing the attaching angle to the indicator hand 103, 104 or changing the range of rotational angle of the indicator hand 103, 104.

As stated above, the electronic wristwatch with indicator hands 100 according to the concrete example, particularly, has the first and second indicator hands 103, 104 separately provided from time hands (minute hand 101, hour hand 102) for showing a time, rotating means (stepping motor 200, wheels 209, 210, 211, hour wheels 212, 213) to reciprocally rotate the first and second indicator hands 103, 104 in directions opposite to each other within a predetermined range, and restricting means to restrict the range in which the first and second indicator hands 103, 104 (ends 227, 228 of the wheel 211, and pin member 226) can move.

Consequently, a variety of representations are possible by the indicator hands 103, 104, and the indicator hands 103, 104 are restricted from rotating to an outside of the restriction range by the restriction means. Accordingly, it is possible to provide an electronic wristwatch with indicator hands 100 capable of restricting against abnormal movement.

Also, it is possible to represent movement of motion in a certain predetermined range, e.g. integrally forming character's hands or legs on each of two indicator hands 103, 104, and to restrict the indicator hands 103, 104 from abnormally moving, which motion cannot be represented by rotation only in one direction. Further, the indicator hands 103, 104 can be restricted from abnormally moving.

Also, where integrally forming figures of both hands on the indicator hands 103, 104, the both hands may be reciprocally moved in a rattling fashion in a predetermined range of movement, or the indicator hands 103, 104 may be set variously in attaching angle, thereby making it possible to represent such motion that the character shows largely waving its hand or clapping its hands. Also, the indicator hands 103, 104 can be restricted from abnormal movement.

Furthermore, by arranging the indicator hands 103, 104 between the time hands (minute hand 101, hour hand 102) and the dial 107, these can be provided with a sense of unity with the design on the dial 107.

Figure 10:
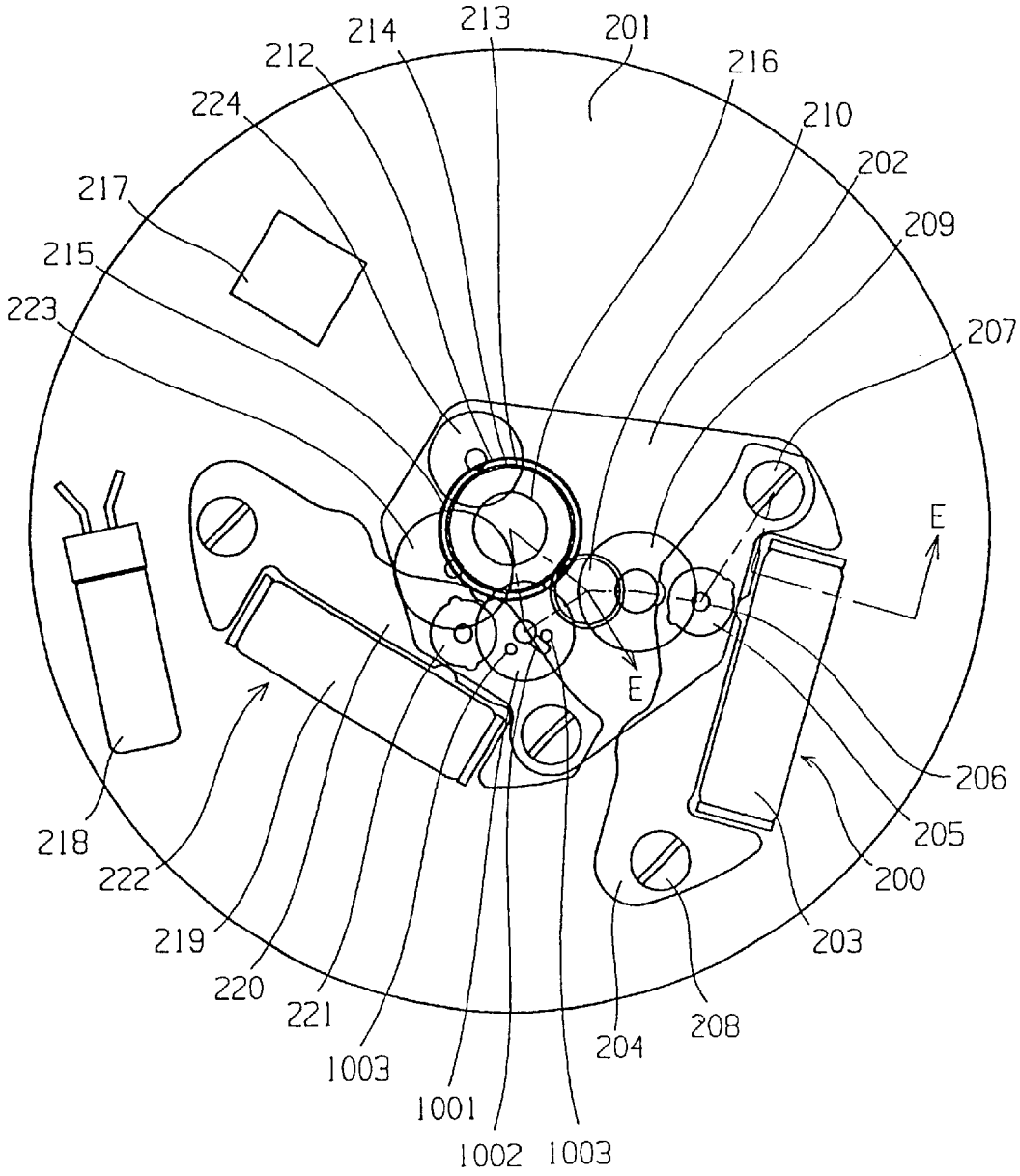
FIG. 10 is a rear view of a driver mechanism to be used for another concrete example of the electronic timepiece with indicator hands according to the invention, which is a figure corresponding to FIG. 2.
Figure 11:
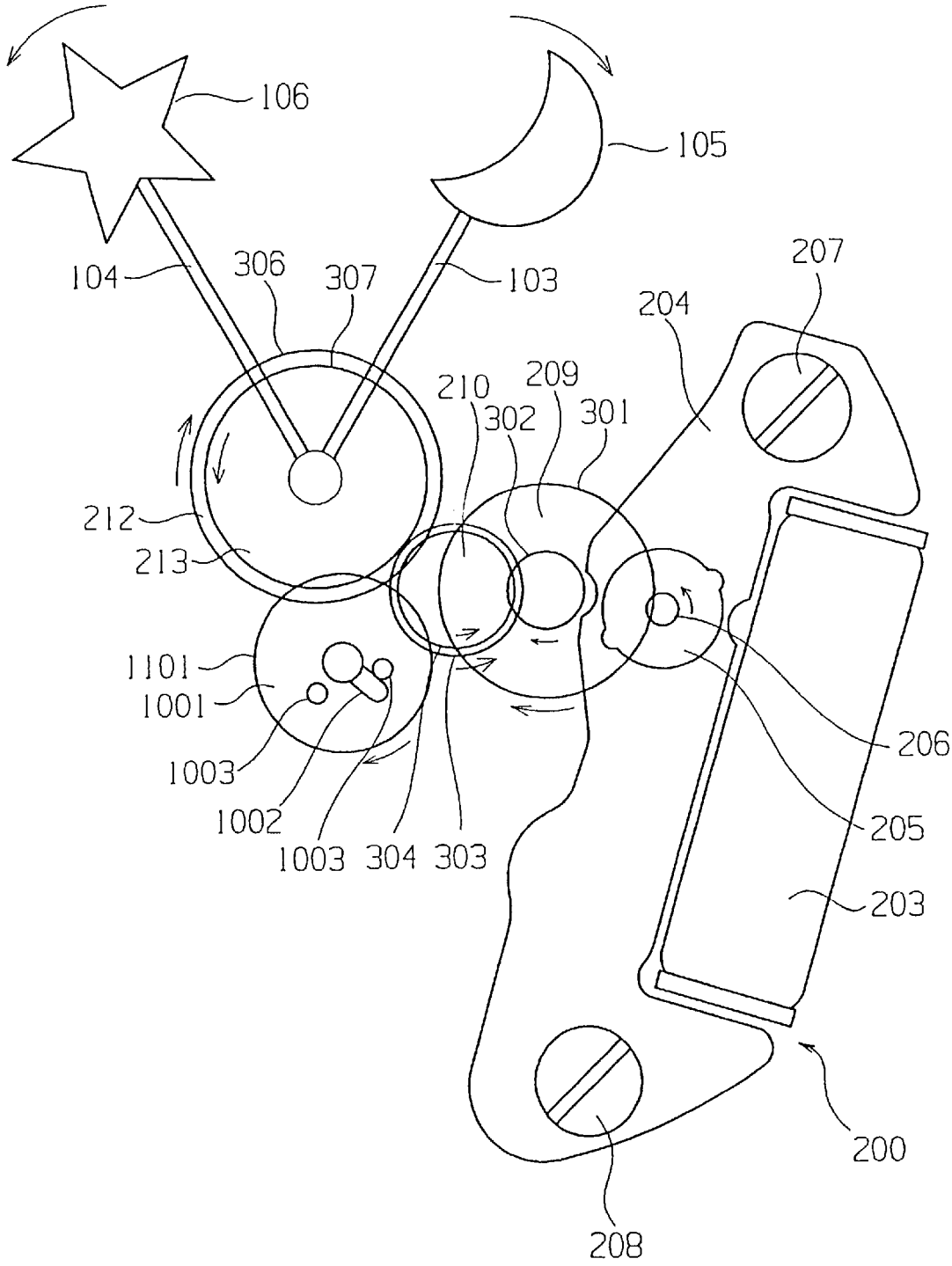
FIG. 11 is an enlarged rear view of a driver mechanism to be used in another concrete example of the electronic timepiece with indicator hands according to the invention.
Figure 12:
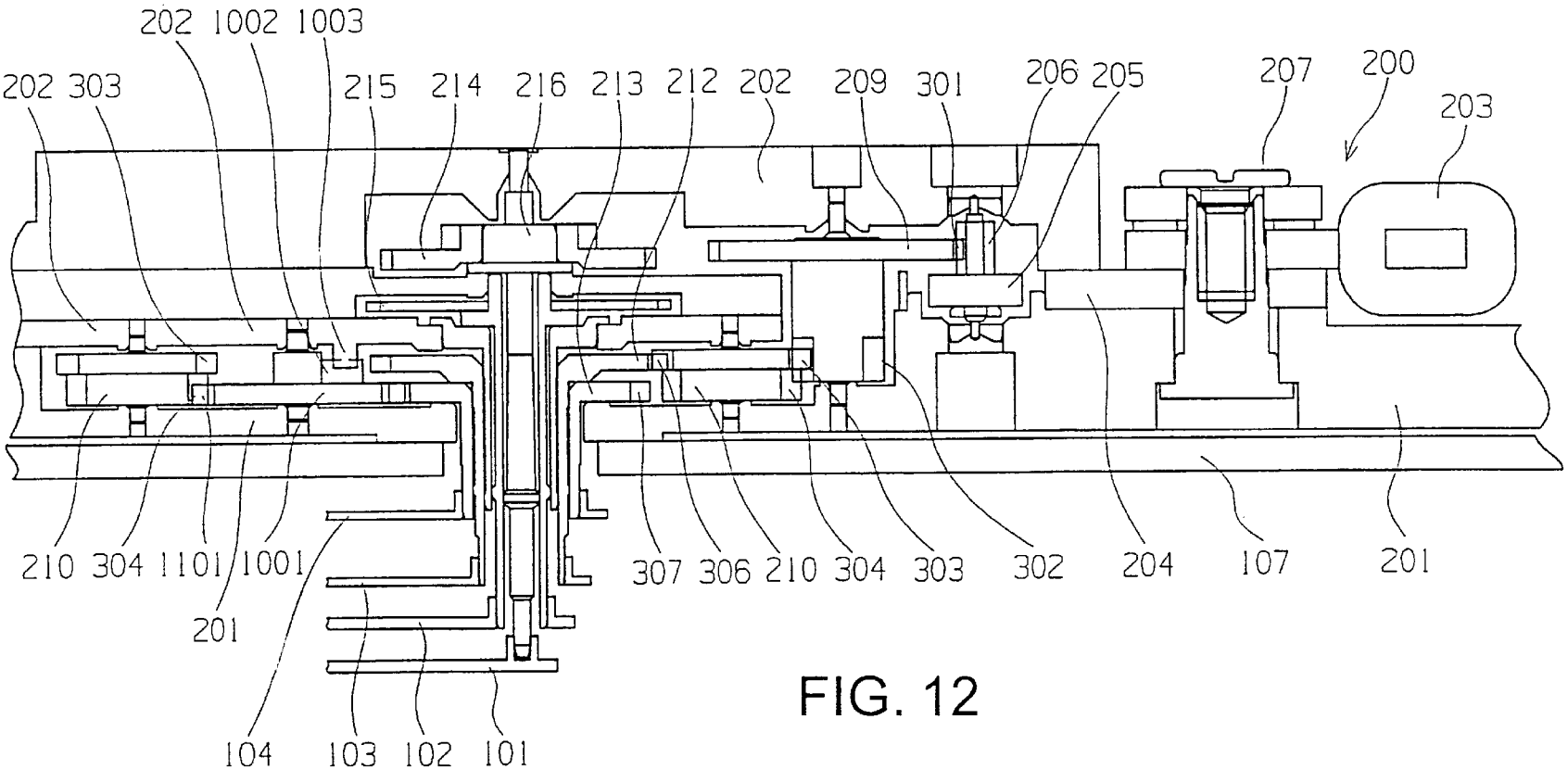
FIG. 12 is an E—E sectional view in FIG. 10.
Figure 13:
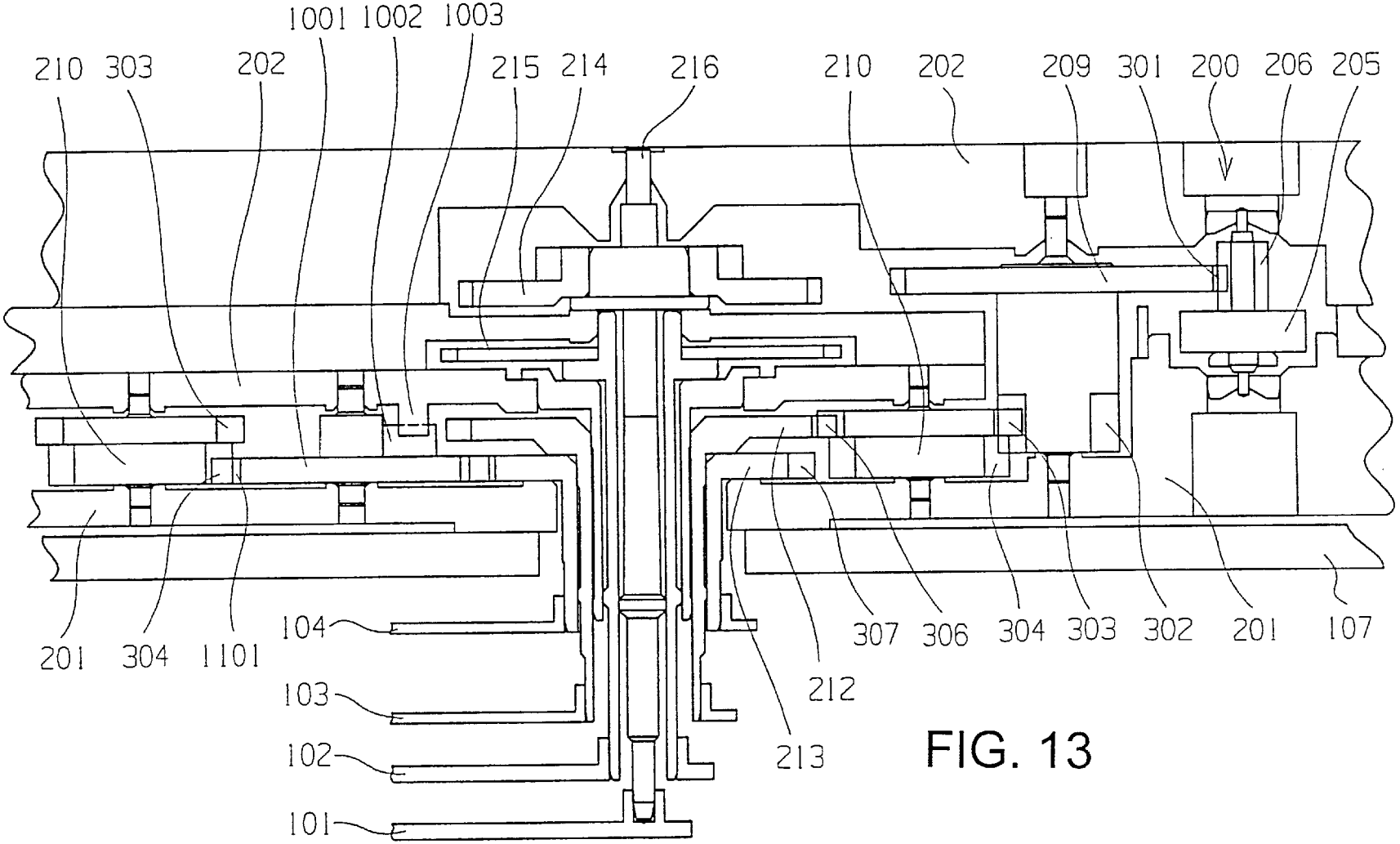
FIG. 13 is a partially enlarged sectional view of FIG. 12.

FIG. 10 to FIG. 13 are figures showing a driving mechanism of another concrete example of an electronic timepiece according to the invention. FIG. 10 is a rear view corresponding to FIG. 2. FIG. 11 is an enlarged rear view of the driving mechanism. FIG. 12 is an E—E sectional view in FIG. 10. FIG. 13 is a partially enlarged sectional view of FIG. 12. Incidentally, in FIG. 10 to FIG. 13 the identical part to FIG. 1 to FIG. 5 are given identical reference numerals.

The difference between the present concrete example and the afore-described concrete example lies in the restricting structure for restricting the rotation of the indicator hands 103, 104. Other structures and operations are the same and hence the explanation described below is only on that difference.

In the present embodiment, a wheel 1001 is employed in place of the wheel 221 in the above-stated example.

The gear 304 of the wheel 210 is in mesh with a gear 1101 of a wheel 1001, and the gear 1101 is in mesh with the gear 307 of the hour wheel 213.

The wheel 1001, at its support plate 202 side, is integrally formed with a convex 1002 structuring a second engaging part. Also, two convexes 1003 structuring a first engaging part is fixed on the surface of the support plate 202 opposit to the wheel 1001. The convex 1002 and the convex 1003 constitutes restricting means.

Where the indicator hands 103, 104 are rotating toward an outside of a predetermined restricting range due to mechanical impact or the like, the wheel 1001 rotates. At this time, the convex 1002 engages one convex 1003 to restrict the rotation of the indicator hand 103, 104. Meanwhile, where rotating toward an outside in the opposite direction of the predetermined restricting range due to mechanical impact or the like, the convex 1002 engages the other convex 1003 to restrict the rotation of the indicator hands 103, 104. Due to this, it is possible to prevent the indicator hands 103, 104 from abnormally moving.

Incidentally, in each of the above-described concrete examples, although the motor used a stepping motor for timepieces structured by the coil 203, the stator 204, and the rotor magnet 205, a motor of another structure may be used.

Also, in each of the above-described concrete examples, although the indicator hands 103, 104 were made to rotate at the same speed, they may be rotated at speeds different from each other.

Furthermore, in each of the above-described concrete examples, although the indicator hands 103, 104 were the same in rotation range, different ranges may be given.

Furthermore, in each of the above-described concrete examples, the time hands were structured by the minute hand 101 and the hour hands, a second hand may be added thereto.

Also, although the restricting means was structured by the ends 227, 228 of the wheel 211 and the pin member 226 fixed on the main plate 201, the pin member 226 may be formed on the side of the support plate 202.

Also, although the restricting means was structured by the convex 1002 formed on the wheel 1001 and the convex 1003 fixed on the support plate 202, various modifications are possible, e.g. the convex 1003 is fixed on the main plate 201 side and the convex 1002 is provided on a side opposed to the main plate 201 of the wheel 1001.

INDUSTRIAL APPLICABILITY

As described above, the electronic timepiece with indicator hands according to the present invention is applicable to various electronic timepieces, from electronic wristwatches to wall-type electronic timepieces and desktop electronic timepieces.

What is claimed is:

1. An electronic timepiece with indicator hands, comprising: time hands (101, 102) showing time; first and second indicator hands (103, 104) provided separately from said time hands (101, 102); rotation means for reciprocally rotating said first and second indicator hands (103, 104) in directions opposite to each other within a predetermined range; and restricting means for restricting the range in which said first and second indicator hands (103, 104) can move.

2. An electronic timepiece with indicator hands according to claim 1, wherein said rotation means reciprocally rotates said first and second indicator hands (103, 104) at the same speed.

3. An electronic timepiece with indicator hands according to claim 2, wherein said rotation means has a motor (200) doing alternately forward rotation and reverse rotation by a predetermined amount, and a train wheel for deliveing rotation of said motor (200) to said first and second indicator hands (103, 104).

4. An electronic timepiece with indicator hands according to claim 3, wherein said restricting means comprising a first engaging part (226, 1003) fixed in a predetermined position and a second engaging part (227, 228, 1002) provided in a wheel (211, 1001) included in said train wheel, and said first engaging part (226, 1003) and said second engaging part (227, 228, 1002) are engaged to restrict rotation of said indicator hand (103, 104) when said indicator hand (103, 104) is rotating toward an outside of a predetermined restricting range.

5. An electronic timepiece with indicator hands according to claim 4, wherein said first engaging part comprising a pin member (226) fixed in a predetermined position, and said second engaging part comprising ends (227, 228) formed by providing a hole (225) in said wheel (211).

6. An electronic timepiece with indicator hands according to claim 4, wherein said first engaging part comprising a convex part (1003) fixed in a predetermined position, and said second engaging part being structured by a convex part (1002) formed integral with said wheel (1001).

* * * * *